US005224313A

United States Patent [19]

Guillebeau, III

[11] Patent Number: 5,224,313

[45] Date of Patent: Jul. 6, 1993

[54] APPARATUS FOR CONSTRUCTING ISOLATION POCKETS

[76] Inventor: Otis P. Guillebeau, III, 493 Mephisto Cir., Lawrenceville, Ga. 30245

[21] Appl. No.: 785,407

[22] Filed: Oct. 31, 1991

[51] Int. Cl.[5] ..... E02D 27/42; E02D 27/50

[52] U.S. Cl. ..... 52/297; 52/295

[58] Field of Search ..... 52/297, 296, 294, 295; 249/83, 91, 163, 168, 4, 6, 9; 404/74, 87

[56] References Cited

U.S. PATENT DOCUMENTS

| | | | |
|---|---|---|---|
| 1,512,905 | 10/1924 | Bunker | 249/168 |
| 1,725,507 | 3/1928 | Clement . | |
| 2,240,016 | 4/1941 | Pinney . | |
| 2,678,482 | 5/1954 | Cuthbertson | 249/4 |
| 3,563,502 | 2/1971 | Dayson . | |
| 3,630,474 | 12/1971 | Minor . | |
| 3,653,169 | 4/1972 | Jenner . | |
| 3,748,806 | 7/1973 | Talandis | 249/33 |
| 4,070,837 | 1/1978 | Sato . | |
| 4,121,804 | 10/1978 | O'Leary | 249/6 |
| 4,124,907 | 11/1978 | Laven | 52/169.1 |
| 4,202,145 | 5/1980 | Coulter et al. | 52/294 |
| 4,295,308 | 10/1981 | Korfanta . | |
| 4,817,353 | 4/1989 | Woods et al. | 52/295 |

FOREIGN PATENT DOCUMENTS

| | | | |
|---|---|---|---|
| 1423929 | 11/1965 | France | 249/4 |
| 2481990 | 11/1981 | France | 249/168 |
| 978482 | 12/1964 | United Kingdom | 249/9 |

OTHER PUBLICATIONS

03250/GRD BuyLine 3036, Circular Isolation Joint Former.

*Primary Examiner*—Carl D. Friedman
*Assistant Examiner*—Christopher T. Kent
*Attorney, Agent, or Firm*—Hopkins & Thomas

[57] ABSTRACT

An improved method of constructing isolation pockets for anchoring the base of a support column in a concrete floor slab structure comprises casting a footing, attaching a corrosion resistant isolation pocket form (37) to the footing with the form bounding a region of the footing and extending upwardly therefrom to an open top, securing the base of the support column to the footing in the bounded region thereof, and incorporating the form into the finished floor structure by compacting a subbase about the exterior of the form, casting a concrete slab atop the subbase, and filling the interior of the form with concrete to substantially the same level as the cast slab on the exterior of the form. A stay-in-place isolation pocket form (37) for use in performing the method is also provided.

10 Claims, 2 Drawing Sheets

APPARATUS FOR CONSTRUCTING ISOLATION POCKETS

TECHNICAL FIELD

This invention relates generally to the construction of large buildings of the type in which the structure of the building is supported atop vertical columns embedded in and extending upwardly from a concrete floor slab. More specifically, the invention relates to methods of creating isolation pockets about the bases of such steel support columns as the surrounding subgrade and concrete floor is formed to allow for adjustment of the columns and concrete encasement of the column bases.

BACKGROUND OF THE INVENTION

Many large buildings, such as warehouses, shopping malls, and the like, are constructed with a steel super-structure that is supported at predetermined intervals atop vertical steel columns that are embedded at their bases within and extend upwardly from the concrete floor slab of the building. When constructing such buildings, concrete footings are generally cast in the ground at the prospective locations of the support columns with the footings having upper surfaces bearing anchor bolts to which the column bases are ultimately secured.

When the footings have thoroughly hardened, the vertically extending steel support columns are mounted thereto by means of the anchor bolts and the remaining steel super-structure of the building is constructed atop the columns. With the super-structure in place, box-shaped wooden forms known as column block-outs are typically built upon the footings surrounding and isolating the support column bases. The floor of the building is then prepared by grading, leveling, and compacting subbase material throughout the floor expanse to a predetermined depth. The subbase is compacted around and against the exterior surfaces of the wooden column block-outs, which isolate the column bases from the subbase material. The concrete slab is then poured on top of the subbase to the upper rims of the wooden forms and allowed to harden thoroughly. In this way, isolation pockets are formed in the floor slab around the bases of the support columns such that the column bases are isolated from the surrounding subbase material and concrete slab. The super-structure of the building can then be precisely aligned by appropriate adjustment of the column bases on their anchor bolts.

With the super-structure precisely aligned, the wooden forms that created the isolation pockets in the floor slab are forcibly removed and the remaining voids are filled with concrete, which provides stability and additional anchoring for the columns, protects the column bases from corrosive elements, and completes the concrete floor of the building. In addition, crack control joints are usually cut in the concrete floor slab with the crack control joints extending between adjacent isolation pockets to provide for controlled cracking of the slab as it expands and contracts with changing temperature.

While the just described method of constructing isolation pockets has been used for years with a measure of success, it nevertheless embodies numerous inherent problems and shortcomings. The mere construction and placement of the wooden forms about the bases of support columns, for example, can be extremely time consuming and wasteful, particularly in very large buildings that may include hundreds of support columns. In addition, the removal of the forms once the surrounding slab has hardened can be even more time consuming and usually results in the destruction of the form and in some cracking and chipping of the concrete floor slab around the lips of the isolation pockets.

In addition to being time consuming and wasteful, prior art techniques utilizing removable wooden forms can and sometimes do result in serious structural problems. For example, when the wooden form is removed so that the isolation pocket can be filled with concrete, the dirt and gravel that typically makes up the subbase beneath the floor slab often becomes dislodged and falls into the isolation pocket creating a partial void beneath a portion of the slab. Such dislodging of the subbase material is virtually unavoidable since the wooden form usually must be removed forcefully with blows from hammers and the like. The long term result can be a deterioration in the strength of the slab and a future collapse thereof in the event a heavy weight, such as a forklift truck, is moved onto the weakened area of the slab.

Another problem with current methods is the inherent requirement that the isolation pockets themselves be filled with concrete after the main slab has hardened and the wooden forms removed. Since the concrete slabs of most buildings will not support the weight of the concrete truck, the isolation pockets typically must be filled manually from wheelbarrows that are trucked by hand from a remotely located concrete truck across the floor slab to the locations of the isolation pockets. Again, this process is extremely labor intensive and thus wasteful of valuable time and money.

Thus, a continuing and heretofore unaddressed need exists for a method and apparatus for constructing isolation pockets that overcomes the problems and shortcomings of the prior art by eliminating wasteful form construction and removal, preventing the dislodging of subbase material in the region of isolation pockets, and eliminating the requirement that the isolation pockets themselves be filled with concrete after the main slab has hardened. It is to the provision of such a method and apparatus that the present invention is primarily directed.

SUMMARY OF THE INVENTION

Briefly described, the present invention comprises an improved method of constructing isolation pockets that utilizes isolation pocket forms that are prefabricated of a durable non-corrosive material and adapted to stay in place embedded within the building floor after construction is complete. In one preferred configuration, the prefabricated form is shaped as a rectangular box having outwardly extending flanges along its bottom edges and having an open top bounded by an upper peripheral lip of the form. In use, the support column footings are poured in the usual way and one of the prefabricated stay-in-place forms is secured to each footing surrounding the anchor bolts thereof. The form can be secured in place by means of concrete nails or other suitable fasteners driven through the lower peripheral flanges of the form and into the concrete material of its corresponding footing.

With one of the forms in place on each footing, the vertically extending steel support columns can be anchored to the footings by means of the anchor bolts and the steel super-structure of the building can be constructed atop the support columns. The super-structure can then be precisely aligned by appropriate manipulations and adjustments of the anchor bolt nuts.

With the footings, isolation pocket forms, support columns, and super-structure in place, the subbase of the building floor can be prepared by grading, leveling, and compacting dirt, gravel, and/or other subbase material within the bounds of the area to be occupied by the finished floor slab. The subbase material is compacted against the exterior surfaces of the isolation pocket forms to a predetermined depth below the upper lips of the forms. The concrete floor slab of the building can then be poured from concrete trucks beginning at one end of the building and working toward the other. However, rather than leaving the isolation pockets unfilled as with prior art methods, the floor slab can be poured and the isolation pockets filled concurrently during the same pouring operation. This is possible with the present invention because the isolation pocket form is adapted to be left in place embedded within the finished concrete floor of the building and does not have to be removed as do prior art wooden forms.

When the concrete of the floor and the isolation pockets have hardened, the exposed upper rim of each isolation pocket can be ground with a suitable grinding apparatus down to the level of the floor. In this way, the concrete does not have to be poured precisely to the rims of the isolation pocket forms but can be poured to a predetermined level below the rims, thus further saving time and money.

Since the floor slab is poured and the isolation pockets filled in the same operation, the highly labor intensive process of filling the isolation pockets from wheelbarrows is eliminated. Furthermore, the inefficient and wasteful construction and removal of prior art wooden forms is eliminated. Also, since the isolation pocket form of this invention stays-in-place embedded within the floor, the subbase material previously compacted against the form is maintained by the form in its highly compacted state such that the dislodging of subbase material in the immediate region of the isolation pockets commonly encountered in the past is eliminated.

It is therefore an object of the present invention to provide a method of constructing isolation pockets that eliminates the labor intensive construction and removal of isolation pocket forms.

A further object of the invention is to provide a method of constructing isolation pockets wherein subbase material around the pocket perimeter is maintained in place and in its highly compacted form to provide support for the concrete slab of the floor.

Another object of the invention is to provide a method of constructing isolation pockets wherein the concrete slab is cast and the isolation pockets filled in the same pouring operation to eliminate manual filling of the isolation pockets after the slab has hardened.

A still further object of the invention is to provide a method of constructing isolation pockets that is simple to implement and economical compared to prior art methods.

An additional object of the invention is to provide a stay-in-place isolation pocket form for use in the improved method of constructing isolation pockets disclosed herein.

Further objects, features, and advantages of the present invention will become more apparent upon review of the following detailed description taken in conjunction with the accompanying drawings.

DETAILED DESCRIPTION OF THE PREFERRED EMBODIMENT

Figure 1:
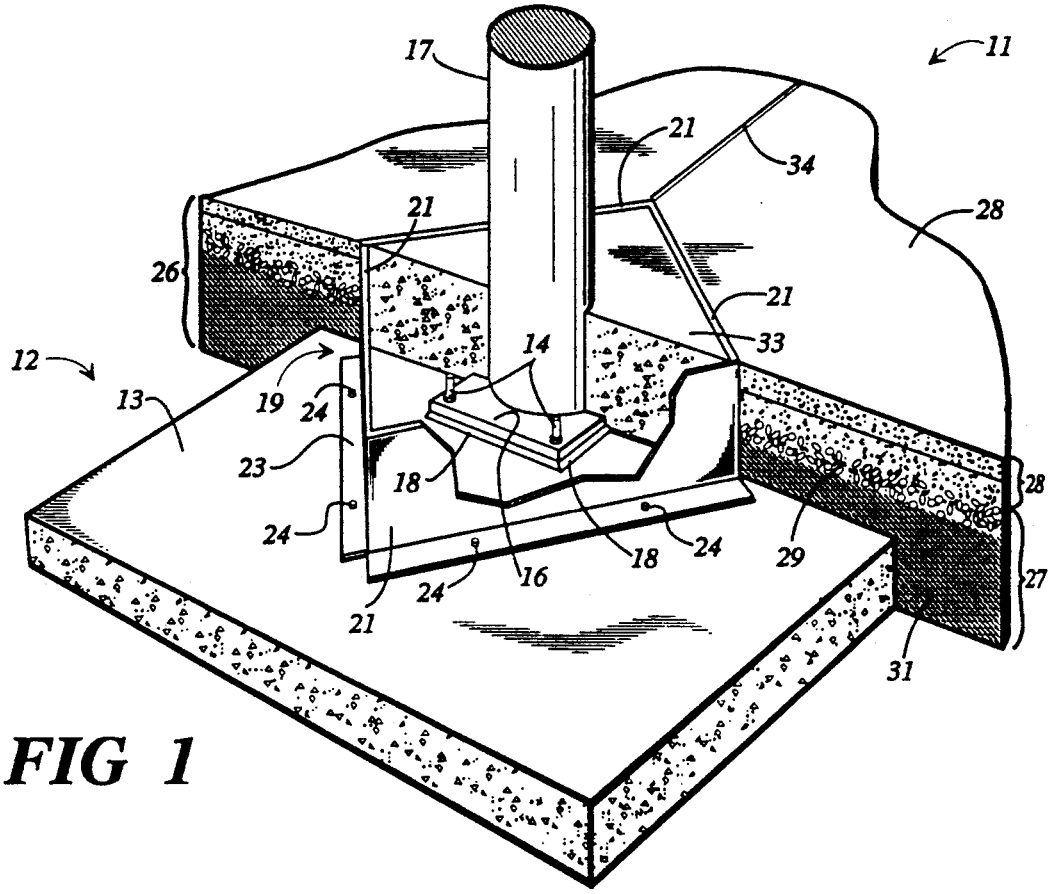
FIG. 1 is a perspective partially sectioned view of an isolation pocket portion of a concrete floor slab that embodies principles of the present invention in a preferred form.

Referring now in more detail to the drawings, in which like numerals refer to like parts throughout the several views, FIG. 1 is a partially sectioned illustration showing a concrete floor slab structure having an isolation pocket formed according to principles of the present invention. The floor structure 11 is seen to comprise a generally rectangular concrete footing 12 that is formed with an upper load bearing surface 13. A set of anchor bolts 14 (only two of which are exposed in FIG. 1) are embedded within and extend upwardly from the upper surface 13 of the footing 12. The anchor bolts 14 provide means for securing the base plate 16 of a vertical support column 17 to the footing 12 using threaded nuts.

A generally rectangular open top form 19 is defined by four side panels 21 joined together at their ends with rivets or other suitable fasteners 22. Each of the side panels 21 has a lower flange 23 that extends outwardly from the side panel along its bottom edge. The form 19 is mounted atop the footing 12 surrounding and isolating the base of support column 17 and is secured in place by means of concrete nails or other suitable fasteners 24 driven through the flanges 23 and into the concrete material of the footing 12. The form 19 is constructed from four similar side panels 21, and each panel 21 can be fabricated of a resilient, corrosion-resistant material such as polyethylene, polypropylene, polystyrene, or other suitable plastics.

A set of corner braces or brackets 20 are disposed in the junctions of adjacent side panels 21 and are secured to each adjoining panel by means of appropriate fasteners such as rivets 36. The brackets 20 serve to brace and provide rigidity to the form 19. Further, the brackets 20 provide for easy assembly of the forms 19 in the field such that the forms can be shipped in a compact disassembled configuration to save shipping costs. The brackets 20 are preferably formed of a metal. With this configuration, the form 19 creates an isolation pocket around the base of support column 17.

The floor slab, generally indicated at reference numeral 26, includes a layered compacted subbase 27 that provides support for the concrete slab surface 28 of the floor. The subbase 27 shown in FIG. 1 comprises a layer of compacted gravel 29 supported atop a layer of compacted dirt 31. While such a gravel/dirt subbase is common in the construction industry, it will be understood by persons of skill in this art that the subbase 27 might well be formed of a variety of materials other than dirt and gravel. The dirt and gravel subbase of FIG. 1, therefore, is presented only as an illustrative embodiment and should not be construed as a limitation of the present invention.

The material of the subbase 27 is compacted against the exterior surface of the form 19, which forms a barrier against migration of the subbase materials into the isolation pocket defined by the form 19. A layer 18 of grout is sandwiched between the baseplate 16 of the support column 17 and the upper surface 13 of the footing 12. This layer 18 of grout serves to transmit load pressures through the column 17 and into the footing 12, stabilizes the footing 12, and protects the under side of the baseplate 16 and the anchor bolts 14 from corrosive elements such as moisture.

The interior of the form 19, which defines the isolation pocket itself, is filled with concrete to the level of the upper surface of slab 28. The concrete 33 serves to anchor the base of the support column 17, provide stability thereto, and protect the base of the column 17 against corrosive elements. Furthermore, the walls 21 of the form 19 function to separate the concrete 33 from the concrete of slab 28 to allow slight relative movement of the two masses of concrete. This movement can be important in preventing unwanted cracking of the concrete slab in the event of slight movements of support columns 17. Linear crack control joints 34 typically are cut in the slab 28 with the crack control joints 34 extending between adjacent isolation pockets surrounding adjacent columns 17. The crack control joints 3 provide for controlled cracking of the slab 28 as the slab expands and contracts in response to changing temperatures.

The upper peripheral rim of the form 19 is seen to be flush with the surface of the concrete floor slab and the concrete of the isolation pocket. As detailed below, this finished configuration can be accomplished by pouring the concrete to a predetermined level below the form upper rim and subsequently cutting or grinding the form down to the surface of the concrete slab. Alternately, the forms 19 can be constructed to have precise depths and the concrete can be poured and finished up to the level of the upper rims of the isolation pocket forms.

While only one isolation pocket and support column 17 is shown in FIG. 1, it will be understood that a large building such as a warehouse might include scores or even hundreds of such structures. In constructing these buildings, the concrete footings 12 are typically cast in the ground at the prospective locations of the support columns 17. The footings 12 usually are cast with the anchor bolts 14 in place such that when the footing hardens the anchor bolts are embedded securely within and extend upwardly from the footings. With the footings 12 cast and thoroughly hardened, an isolation pocket form 19 can be secured to the upper surface of each footing surrounding and isolating the anchor bolts 14 of the footing. The forms can be secured in place by suitable fastening means driven through the form flanges 23 and into the concrete of the footings 12. In this regard, it has been found expedient to fasten the forms to the footings using concrete nails fired from a conventional stud gun.

With the footings 12 and isolation pocket forms 19 in place, the vertical steel support column 17 can be anchored to their respective footings using anchor bolts 14 and nuts. In most instances, the support columns 17 are formed with a lower plate 16 having holes positioned to receive the anchor bolts 14. Usually, each of the anchor bolts 14 includes a lower nut upon which the base of the column rests and an upper nut that can be tightened against the upper surface of the plate 16 to secure the column to the footing.

With the support columns 17 anchored to their respective footings 12, the skeletal steel structure of the building can be constructed atop the columns 17, which support the structure at predetermined intervals. The entire skeletal structure can then be precisely aligned through appropriate adjustments of the anchor bolt nuts 18. When the structure has been aligned properly, grout 18 is injected beneath the baseplates 16 of the columns 17 and allowed to harden to support the load borne by the column and to protect the underside surface of the plates 16.

The floor of the building can next be prepared by grading, leveling, and compacting the materials of the subbase 27 about and against the exterior surfaces of the isolation pocket forms 19 to a predetermined depth beneath the upper peripheral rims of the forms. It will be understood that at this stage of the construction procedure, the upper surfaces 13 of the footings 12 are covered with compacted subbase material outside of the forms 19 while the portion of the footing upper surfaces within the forms 19 as well as the bases of support columns 17 remain exposed within the isolation pocket.

Finally, the concrete floor slab itself can be poured from a concrete truck beginning at one end of the building and working toward the other end thereof. In pouring the floor, both the slab 28 and the concrete 33 within the isolation pockets are poured simultaneously. This is possible with the present invention because the isolation pocket form itself is constructed of a corrosion resistant material and is designed to remain in place embedded within the concrete floor of the finished building. The concrete 33 poured within the isolation pocket form serves to encase and protect the bases of the support columns 17 while providing additional anchoring weight for the bases Using the method of this invention, therefore, the inefficient and time-consuming construction and destruction of isolation pocket forms as well as the necessity that the pockets themselves be filled manually from wheelbarrows after the concrete of the slab 28 has hardened is completely eliminated. Thus, an enormous amount of time and effort and thus money is saved when principles of the present invention are applied. Furthermore, the walls 21 of the embedded isolation pockets 19 provide for slight movement of the isolation pocket concrete 33 with respect to the slab 28 and thus tends to prevent unwanted cracking of the slab as the building structure moves in response to temperature or wind.

If desired, the concrete of the floor and the isolation pockets can be poured and finished precisely to the upper peripheral rims of the forms 19, in which case the floor is completed when the concrete hardens. Alternatively, the concrete can be poured to a level below the upper rims of the forms and, upon hardening of the slab, the forms can be ground with an appropriate grinding device down to the level of the floor slab. With the latter method, precise and time consuming leveling and finishing of the slab during the pouring operation is eliminated.

Figure 3:
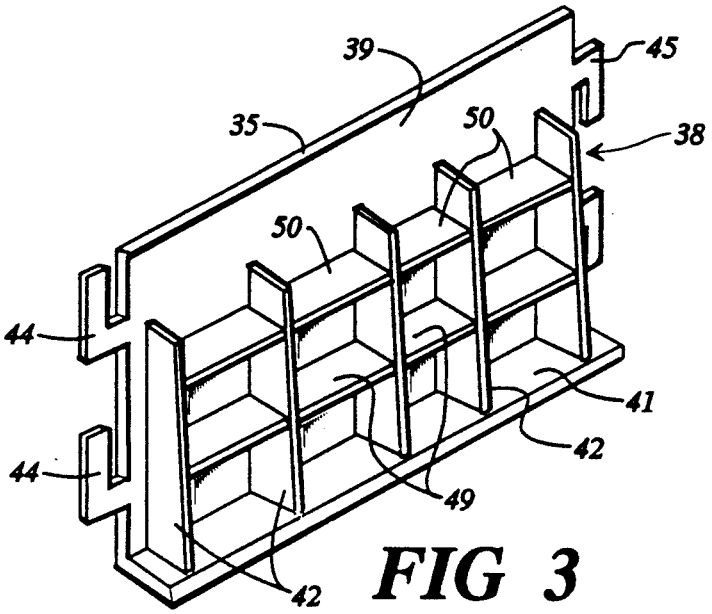
FIGS. 3 and 4 show a second embodiment of an isolation pocket form constructed according to principles of the present invention.
Figure 4:
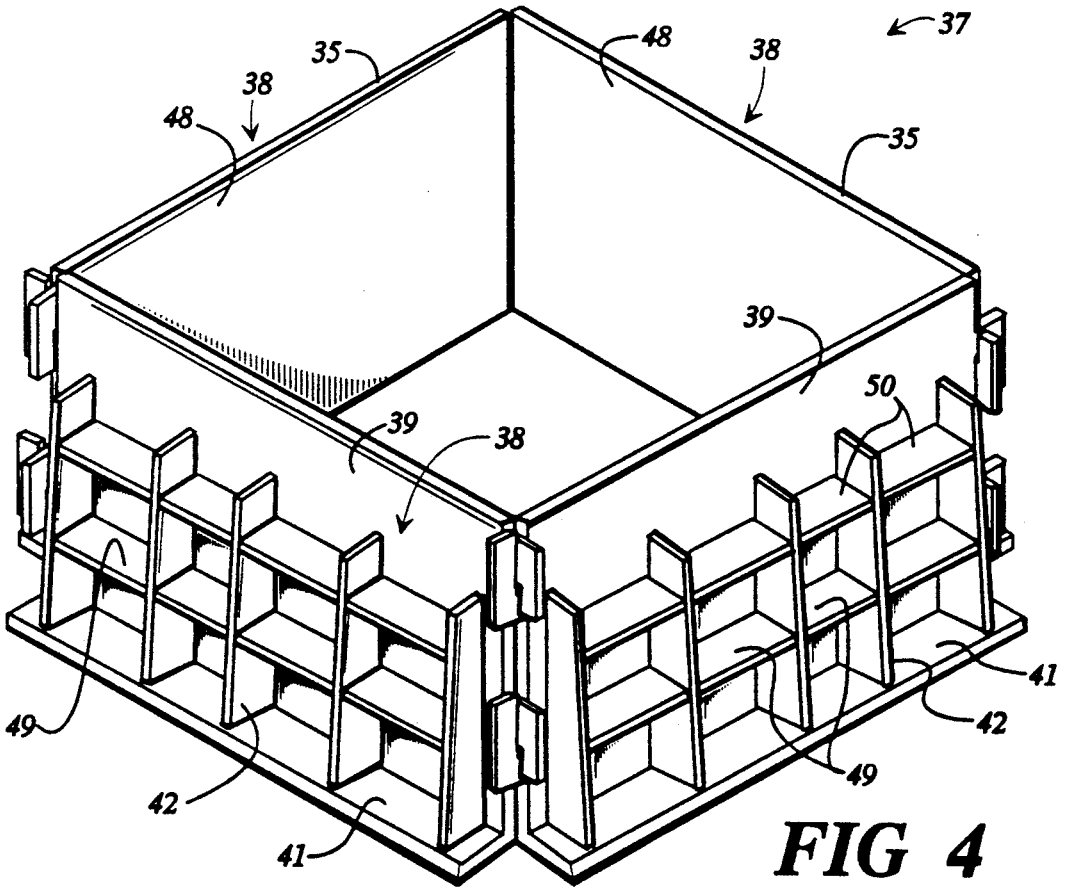

FIGS. 3 and 4 illustrate a second embodiment of an isolation pocket form embodying principles of the present invention. The embodiment of FIGS. 3 and 4 is particularly suited to manufacture through an injection molding process and is therefore economical. The isolation pocket form 37 is constructed of four similar injection molded plastic panels 38 that are joined together at their ends to define the form. Each of the panels 38 comprises a wall 35 having a generally rectangular exterior face 39 and a lower flange 41 along its lower edge. An array of vertical buttresses 42 is integrally formed with each panel 38 and the buttress 42 extend between the panel outer face 39 and its lower flange 41. The buttresses 4 provide rigid support for the flanges 41 and also increase the resiliency and strength of the panel outer faces 39.

Figure 2:
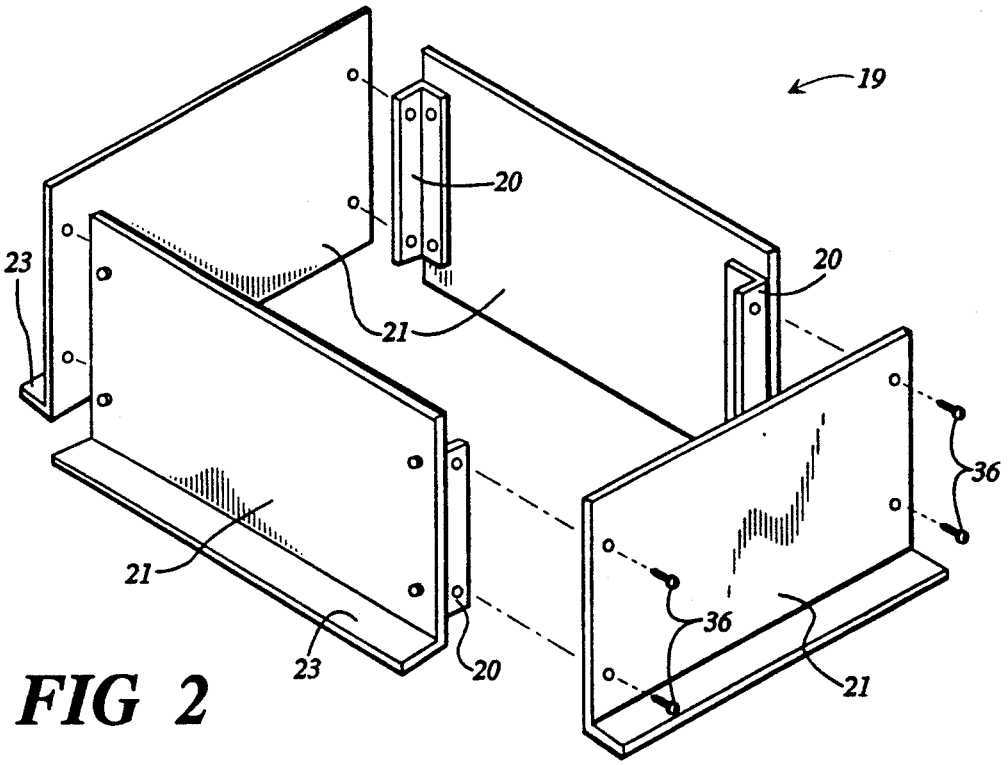
FIG. 2 is a perspective expanded view of the first embodiment of an isolation pocket form constructed according to principles of this invention.

The end vertical edges of each panel 38 are formed with locking protrusions 44 and 45, with the protrusions 44 at one end being formed to engage and lock with protrusions 45, so that the opposing ends of adjacent panels can be secured when the form 37 is constructed. In this regard, and as with the embodiment of FIG. 2, the forms can be shipped in a disassembled configuration and the panels can be secured together on site to create the forms 37.

The exterior face 39 of each of the panels 38 also is formed with a pair of spaced parallel horizontal ribs 49 and 50. The horizontal ribs 49 and 50 extend in a direction transverse to that of the buttresses 42 on the outside face of each panel 38. The ribs are joined to the exterior face 39 of the panels and to the vertical buttresses 42. In this way, the ribs 49 in conjunction with the buttresses 42 provide for a strong resilient structure that can withstand the compacting of subbase material and the pouring of a concrete slab against its outer surface.

The invention has been described herein in terms of preferred embodiments and methodologies. It will be obvious to those of skill in this art, however, that numerous variations upon the illustrated embodiments might be effected within the general scope of the invention. For example, the isolation pocket forms have been illustrated as being square or rectangular. Obviously, forms of other shapes and configurations might perform equally well, such as triangular, circular, or trapezoidal. Further, the forms of the present invention have been illustrated as being made of plastic. However, materials other than plastic might well be suitable such that a composition of plastic should not be considered to be a limitation of the present invention. Finally, while the method of the invention has been described with its steps occurring in a particular sequence, it is obvious that many of the steps of the process might well be performed in a different order without detracting from the invention itself. For example, the concrete of the isolation pocket might well be poured before the concrete of the slab or the compacting of the subbase material. Also, the placement of the support columns, construction of the superstructure, and alignment thereof might be performed expediently at stages of the process other than those of the illustrated exemplary embodiment. These and many other additions, deletions, and modifications might well be made to the embodiments illustrated above without departing from the spirit and scope of the invention a set forth in the claims.

I claim:

1. In a floor structure of a building, a footing, a fastening means mounted to said footing for supporting a vertical support column, a stay-in-place isolation pocket form mounted on said footing and surrounding said fastening means for creating a permanent stay-in-place isolation pocket about said fastening means at the base of the vertical support column as an adjacent concrete floor slab is prepared and cast, the improvement therein of said isolation pocket form comprising:

a plurality of panels mounted on said footing and secured together to define a substantially open configuration surrounding said fastening means and permanently isolating said fastening means from the concrete of the adjacent floor slab, at least some of said panels including means which affix the form to said footing, said panels being constructed of plastic material adapted to be left in place on said footing and embedded within the concrete of the floor after the floor has been cast and has hardened forming a floor surface and adapted to be trimmed level with of the floor surface to make the panels flush with the floor surface.

2. A stay-in-place isolation pocket form as claimed in claim 1 and wherein said plurality of panels comprises four panels secured together to define an open substantially rectangular configuration, each of said panels being formed with a lower flange and a plurality of buttresses with transverse ribs extending from the flange and along the panel for enhancing the rigidity of the form.

3. A stay-in-place isolation pocket form as claimed in claim 2 and wherein each of said panels is formed with connector means for securing adjacent panels together, said connector means comprising a locking protrusion for securing a corresponding panel to an adjacent panel via slidable mating engagement with a similar locking protrusion located on an adjacent panel.

4. In a floor structure of a building, a footing, a fastening means mounted to said footing for supporting a vertical support column, and an isolation pocket form mounted on said footing and surrounding said fastening means for isolating the fastening means at the base of the vertical support column from an adjacent concrete floor slab, the improvement therein of said pocket form comprising:

a plurality of elongate panels mounted on said footing and secured together at their ends to define an open configuration surrounding and isolating said fastening means and the base of the support column, said panels being formed from a rigid plastic corrosion resistant material and left permanently in place on said footing, said plurality of panels configured to receive concrete within said open configuration about said fastening means and outside of said open configuration when an adjacent concrete floor slab is formed to make a floor surface, and means situated on said panels affixing said panels to said footing;

said panels being trimmed at the floor surface to make the trimmed portions of said panels flush with the floor surface.

5. The apparatus of claim 4, further comprising a plurality of buttresses with transverse ribs extending along for enhancing the rigidity of said panels.

6. The apparatus of claim 4, further comprising a locking protrusion situated at an end of each of said panels, said locking protrusion for securing a corresponding panel to an adjacent panel via slidable mating engagement with a similar locking protrusion situated on said adjacent panel.

7. The apparatus of claim 4, further comprising subbase material beneath said adjacent concrete floor slab and adjacent to said plurality of said panels.

8. In a floor structure for a building, a footing, a fastening means mounted to said footing for supporting a vertical support column, an isolation pocket form mounted on said footing and surrounding said fastening means for isolating said fastening means at the base of the vertical support column from an adjacent concrete floor slab, the improvement therein of said isolation pocket form comprising:

a panel means mounted on said footing and surrounding said fastening means and isolating said fastening means from the concrete of the adjacent floor slab, said panel means having a plurality of panels secured together to define an opening surrounding said fastening means, said panels being formed from a rigid corrosion resistant material left permanently in place on said footing, said panel means receiving concrete within said opening defined by said panels and laterally supporting the concrete floor slab disposed outside the opening of said panels when forming an adjacent concrete floor slab so that said panel means is permanently embedded between concrete received in the opening of said panel means and the concrete of an adjacent floor slab; and said panels including a lower flange means affixing said panel means to said footing;

whereby the isolation pocket form permits slight relative movement between the concrete received in the opening of the panel means and the concrete of the adjacent floor slab.

9. The apparatus of claim 8, and wherein said plurality of panels each includes a plurality of buttresses with transverse ribs for enhancing the rigidity of said panel.

10. The apparatus of claim 8, further comprising each of said panels including a protrusion for securing a panel to an adjacent panel via slidable mating engagement with a similar locking protrusion situated on said adjacent panel.

* * * * *